United States Patent [19]

Zvi et al.

[11] Patent Number: 4,630,396

[45] Date of Patent: Dec. 23, 1986

[54] SECURITY GATE APPARATUS

[75] Inventors: Zadok Zvi, Fort Lee, N.J.; Abraham Kendi; Emile Tal-Mor, both of New York, N.Y.

[73] Assignee: Kendi Security, Inc., New York, N.Y.

[21] Appl. No.: 726,845

[22] Filed: Apr. 24, 1985

[51] Int. Cl.[4] ..... E06B 3/68

[52] U.S. Cl. ..... 49/55; 49/56; 49/395; 292/162; 292/189

[58] Field of Search ..... 49/55, 56, 57, 395; 292/33, 189, 183, 162

[56] References Cited

U.S. PATENT DOCUMENTS

| | | | |
|---|---|---|---|
| 1,820,715 | 8/1931 | Vance | 49/395 X |
| 2,803,074 | 8/1957 | Brokish | 49/55 X |
| 3,087,750 | 4/1963 | Kelly | 49/56 X |
| 4,249,345 | 2/1981 | Littleton | 49/56 |
| 4,452,011 | 6/1984 | Trombettas | 49/56 |

*Primary Examiner*—Kenneth Downey

*Attorney, Agent, or Firm*—James J. Romano, Jr.

[57] ABSTRACT

Security gate apparatus for securing building openings in the nature of window and door openings are disclosed; and comprise a security gate including gate-carried locking means which, while of particularly sturdy construction and effective to render it extremely difficult if not impossible as a practical matter to open the security gate from without the building opening, are nonetheless virtually foolproof in operation, and which are very readily and conveniently openable from within the building, even by those of somewhat limited mental and/or physical capacities, in readily apparent manner to thereby insure virtually immediate exit from the building through the building opening for the building occupants in emergency situations. Fixed security means are operatively associated with the security gate, and are of readily and conveniently adjustable extent; to thereby enable the ready adjustment in situ of the size of the security gate apparatus, and provide for significant versatility of application of the security gate apparatus with regard to the range of sizes of the building openings which may be effectively secured thereby.

20 Claims, 7 Drawing Figures

SECURITY GATE APPARATUS

BACKGROUND OF THE INVENTION

1. Field of the Invention

This invention relates to new and improved security gate apparatus for securing building openings in the nature of window and door openings against forced entry from without the building; and, more particularly, to such apparatus as provide for virtually immediate emergency exit from within the building through the thusly secured building opening without sacrifice in the security of the latter.

2. Description of the Prior Art

Although a wide variety of security gate apparatus for securing building openings against forced entry from without the building while nonetheless providing for emergency exit through the building opening from within the building are, of course, known in the prior art, no such prior art apparatus are known which accomplish these functions with the significant combination of safety regarding ease of virtually immediate emergency exit for the building occupants, a very high degree of security against forced entry from without the building, simplicity of design, construction and operation, economy of design and construction, and versatility of application, as is provided by the security gate apparatus of our invention.

More specifically, although the security gate disclosed in U.S. Pat. No. 4,358,910 to Keating, et al provides for a good measure of security, it is clear that the same is by no means virtually immediately openable from within for emergency exit and is, in any event, of somewhat cumbersome and complex construction.

U.S. Pat. No. 2,924,862 to Pellicore discloses a security gate which is somewhat deficient regarding security in that the same is disposed to the outside of the building opening which it protects, and is by no means that readily openable from within the building as to provide for virtually immediate emergency exit. In addition, this security gate, in particular the gate locking means, are clearly of overly complex design, construction, and manner of operation.

U.S. Pat. No. 3,087,750 to Kelly discloses a security gate which is clearly deficient in terms of security in that the same is of obviously somewhat flimsy design and construction and is disposed to the outside of the building opening which it protects. In addition, the locking means for this security gate are of particularly complex design, construction and manner of operation, and the reliability thereof under harsh operational conditions is clearly suspect.

U.S. Pat. Nos. 3,921,334 to Black, Sr., 4,000,590 to Kordewick, 4,019,281 to Weiler, 4,055,360 to Russi, 4,057,935 to Rohrberg, et al, 4,208,837 to Black, Sr., et al, 4,111,472 to Smith, et al, 3,396,489 to Cirone, and 4,274,228 to Kondracki, respectively, each disclose security gate apparatus, and/or locking means therefor which, although generally related in overall function to the security gate apparatus of our invention are, in each instance, clearly remote therefrom in terms of design, construction, and manner of operation.

OBJECTS OF THE INVENTION

It is accordingly an object of this invention to provide new and improved security gate apparatus for securing building openings in the nature of window and door openings against forced entry from without the building.

It is another object of this invention to provide new and improved security gate apparatus as above which provide for virtually immediate emergency exit from within the building through the secured building opening without sacrifice in security.

It is another object of this invention to provide new and improved security gate apparatus as above wherein the virtually immediate emergency exit is achievable even by those under some measure of physical and/or mental disability, as for example relatively small children, the aged and, to a reasonable degree, the mentally or physically infirm.

It is another object of this invention to provide new and improved security gate apparatus as above which are of particularly sturdy design and construction, and which inherently function to render destuctive disassembly of the apparatus from without the building particularly difficult, to thus provide for a very high degree of building opening security.

It is another object of this invention to provide new and improved security gate apparatus as above which are of particularly simple and economical design and construction.

It is another object of this invention to provide new and improved security gate apparatus as above which require the use of only readily available components of proven effectiveness in basically "off the shelf" form, and the use of only well known and long-practiced fabrication techniques, for apparatus constuction and installation.

It is another object of this invention to provide new and improved security gate apparatus as above which, due in large measure to the simplicity of the apparatus, and the inherent robustness of the apparatus components and assembly techniques, are virtually maintenance-free, thus insuring apparatus reliability over the long term.

It is a further object of this invention to provide new and improved security gate apparatus as above which are of particular versatility of application.

SUMMARY OF THE INVENTION

As disclosed herein, the new and improved security gate apparatus of our invention comprise outer frame means for fixed mounting in a building opening to be secured; security gate means pivotally mounted from the outer frame means and moveable relative thereto from a closed security gate position wherein the same secure the building opening against unauthorized entry therethrough from without the building, to an open security gate position wherein the building opening is open to the exit of the building occupants therethrough; and security gate locking means for locking the security gate in the closed position thereof. The security gate locking means are of particularly sturdy construction; and are specifically configured and arranged in conjunction with the security gate to prevent opening of the locking means from without the building while, at the same time, enable the particularly simple, convenient and virtually immediate opening of the locking means from within the building as required for immediate emergency exit of the building occupants through the building opening. In addition, operation of the security gate locking means is virtually foolproof in that the same lock automatically under the influence of the force of gravity when the security gate is moved to the fully closed position thereof and released, and it is impossible to move the security gate to its fully closed position without first actuating the locking means to lock automatically as above upon release of the security gate. Fixed security gate means, of extent which is readily and conveniently determinable and/or adjustable in situ, are operatively connectable to the outer frame means to provide for very significant versatility of application of the security gate apparatus with regard to the size(s) of the building opening(s) to be secured thereby. This can enable the fabrication to significant economic advantage of standard size outer frame means and security gate means at a central location; and the adaptation, through in situ determination and/or adjustment of the extent of the fixed security gate means, of the same for use in the securing of building openings of a wide variety of different sizes.

DESCRIPTION OF THE DRAWINGS

The above and other objects and significant advantages of the security gate apparatus of our invention are believed made clear by the following detailed description thereof taken in conjunction with the accompanying drawings wherein.

DETAILED DESCRIPTION OF THE INVENTION

Figure 1:
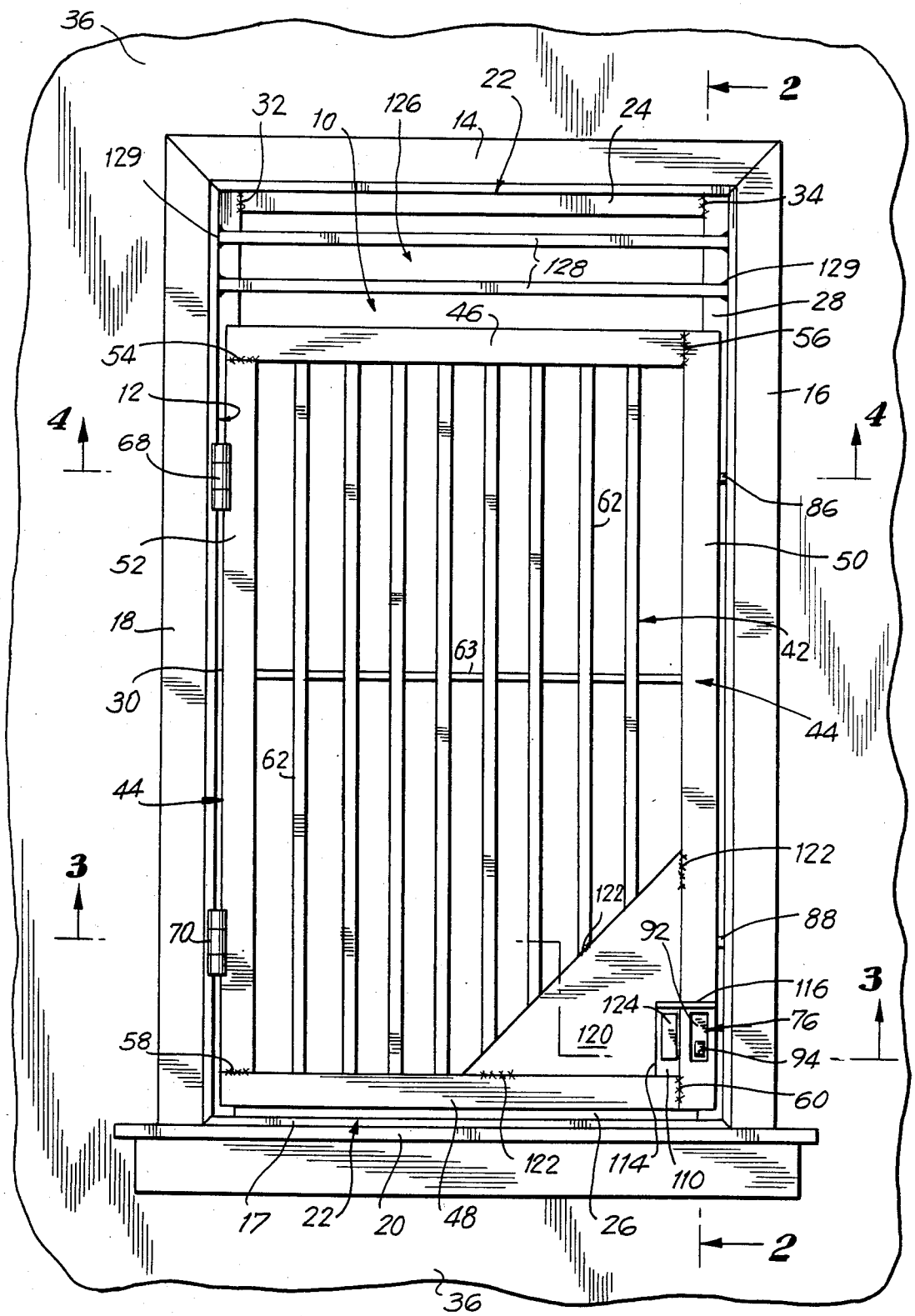
FIG. 1 is a front elevational view of a first embodiment of new and improved security gate apparatus constructed and operative in accordance with the teachings of our invention, and operatively disposed in a window opening as seen from the inside of the latter.

Referring now to FIG. 1 of the drawings, new and improved security gate apparatus constructed and operable in accordance with the teachings of our invention are indicated generally at 10; and are representatively depicted as operatively emplaced to secure a building window opening as generally indicated at 12. FIG. 1 depicts the security gate apparatus 10 as seen from the inside of the building, and thus from the inside of the window opening 12.

The window opening 12 is conventionally framed as shown by window frame members 14, 16 and 18, and window sill 20, which respectively form no part of the apparatus of the invention. A window, not shown, which may take any known configuration is disposed and supported in window opening 12 to the opposite side of apparatus 10 as that seen in FIG. 1. In most instances, it is contemplated that the window would be openable for purposes of building ventilation, but this is not required for operation of the apparatus 10.

The security gate apparatus 10 comprise a box-like, stationary outer frame as generally indicated at 22. In the representatively depicted use of the security apparatus 10, the outer frame 22 comprises generally horizontally extending frame members 24 and 26, and generally vertically extending frame members 28 and 30, which are very securely joined together at the respective overlapping end portions thereof as by welding as indicated at 32 for outer frame members 30 and 24, and at 34 for outer frame members 24 and 28. The respective outer frame members 24, 26, 28 and 30 are constituted by structural components which are particularly resistant to deformation in the nature of bending; and, to this effect, may take the form as depicted of angle iron members to, in conjunction with the welds at the overlapping outer frame member end portions, result in an outer frame 22 of very substantial structural integrity and strength.

The outer frame 22 is very strongly secured in the window opening 12 in any appropriate manner, as for example by closely spaced, generally inaccesible screws of substantial length, diameter and thread depth which extend well into the adjacent structure of the building wall as shown at 36. Two such screws are depicted at 38 and 40 in FIG. 3 for the securing of outer frame members 28 and 30 in the window opening 12.

Of course, the respective lengths of the outer frame members 24, 26, 28 and 30 are dictated by the dimensions in height and width of the window opening 12, and may be readily determined and fixed on site to thus provide for substantial versatility of application for the security gate apparatus 10 of our invention.

Further included in the security gate apparatus 10 of our invention is an openable, and lockable, security gate as generally indicated at 42 in FIG. 1. The security gate 42 comprises a box-like, inner frame generally indicated at 44 which is made up from generally horizontally extending inner frame members 46 and 48, and generally vertically extending inner frame members 50 and 52, which are again very securely joined together at the respective overlapping end portions thereof as by welding as indicated 54, 56, 58 and 60, respectively. The horizontally extending inner frame members 46 and 48, and the vertically extending inner frame member 52, are constituted by structural components which are particularly resistant to deformation in the nature of bending, again for example angle irons; while the vertically extending inner frame member 50 which must meet the same criteria is constituted by an iron tubular member of generally rectangular cross section as clearly seen in FIGS. 2 through 5. Again, this construction results in an inner frame 44 of very substantial structural integrity and strength. Iron security bars, which may take the depicted square cross section, are indicated at 62, and extend in the depicted, generally vertical spaced manners between the respective inner frame members 46 and 48 to overlap each of the same, not shown. Welds, not shown, very strongly secure the bars 62 to the frame members 46 and 48; and at least one generally horizontally extending iron security bar 63 is provided and welded, again not shown, to the vertically extending inner frame members 50 and 52. Thus, it is clear that the described construction of the security gate 42 results in a security gate assembly of very substantial structural integrity and strength.

Figure 3:
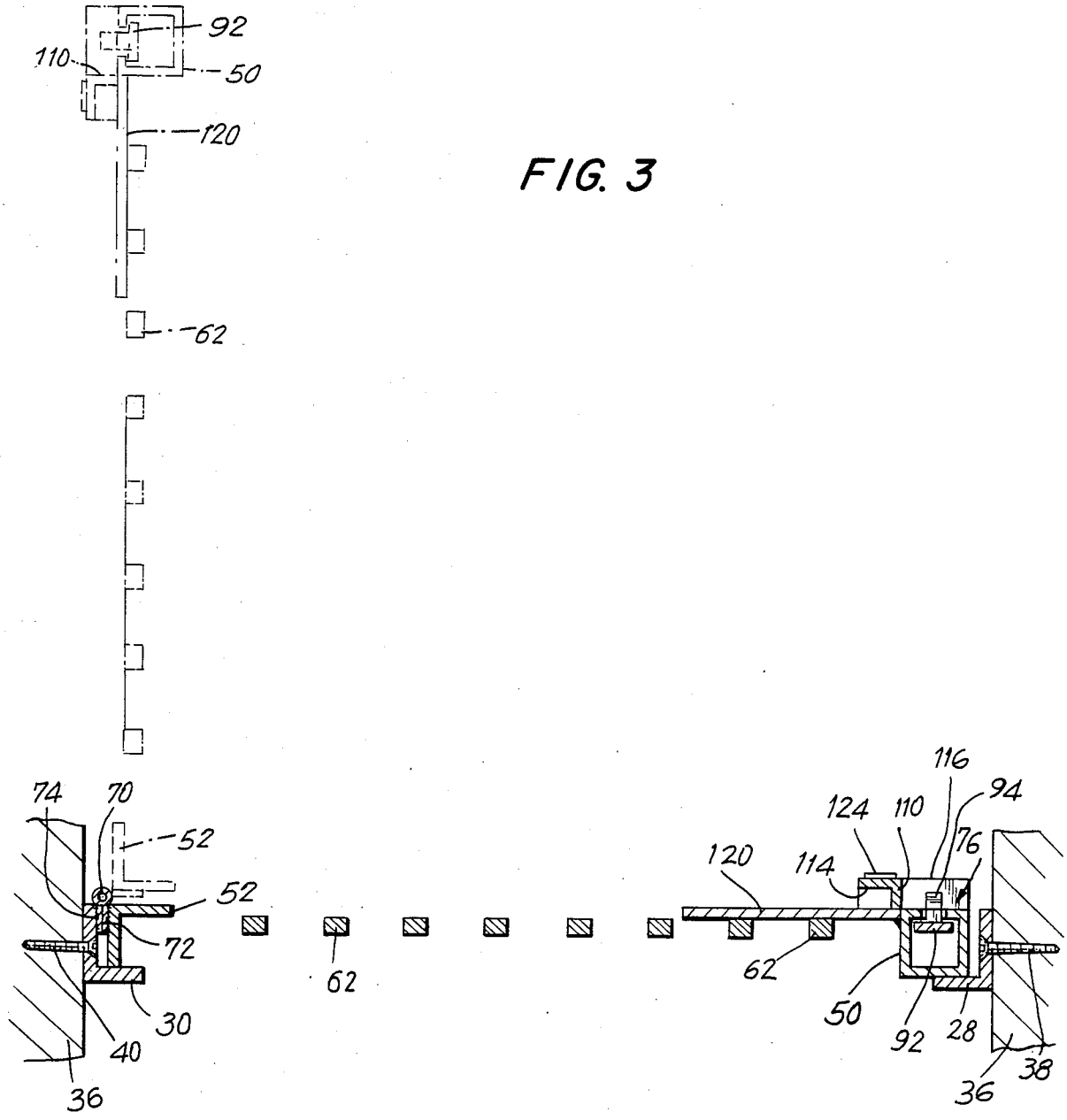
FIG. 3 is a cross sectional view taken generally along line 3—3 in FIG. 1.
Figure 4:
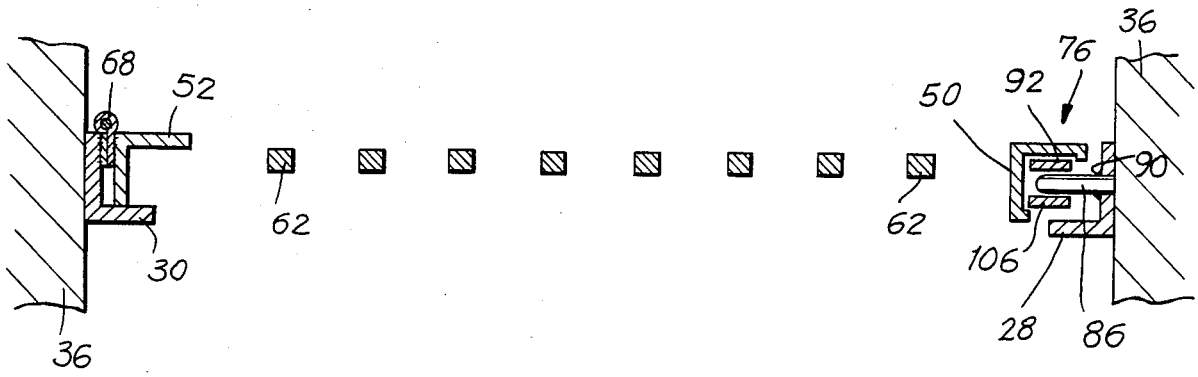
FIG. 4 is a cross sectional view taken generally along line 4—4 in FIG. 1.

The security gate 42 is pivotally supported from the outer frame by spaced hinges 68 and 70 of particularly sturdy construction which are strongly secured to the outer frame member 30 and the inner frame member 52 as by welding as indicated at 72 and 74 in FIG. 3 for hinge 70. Thus, the security gate 42 is readily moveable by swinging from the closed position thereof as seen in FIGS. 1, 3 and 4, to the open position thereof as shown in phantom in FIG. 3, and vice versa.

Figure 2:
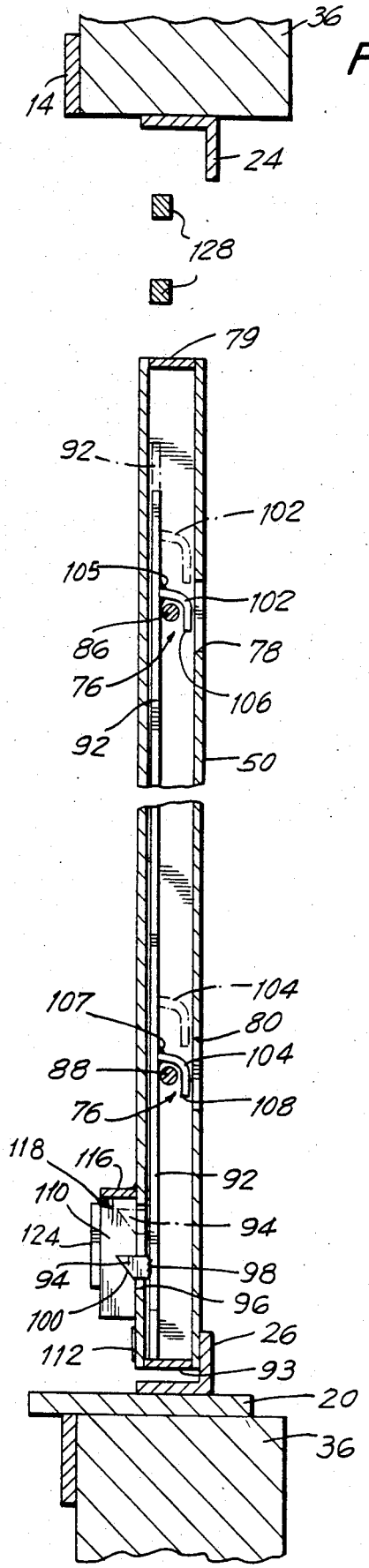
FIG. 2 is a cross sectional view taken generally along line 2—2 in FIG. 1.
Figure 5:
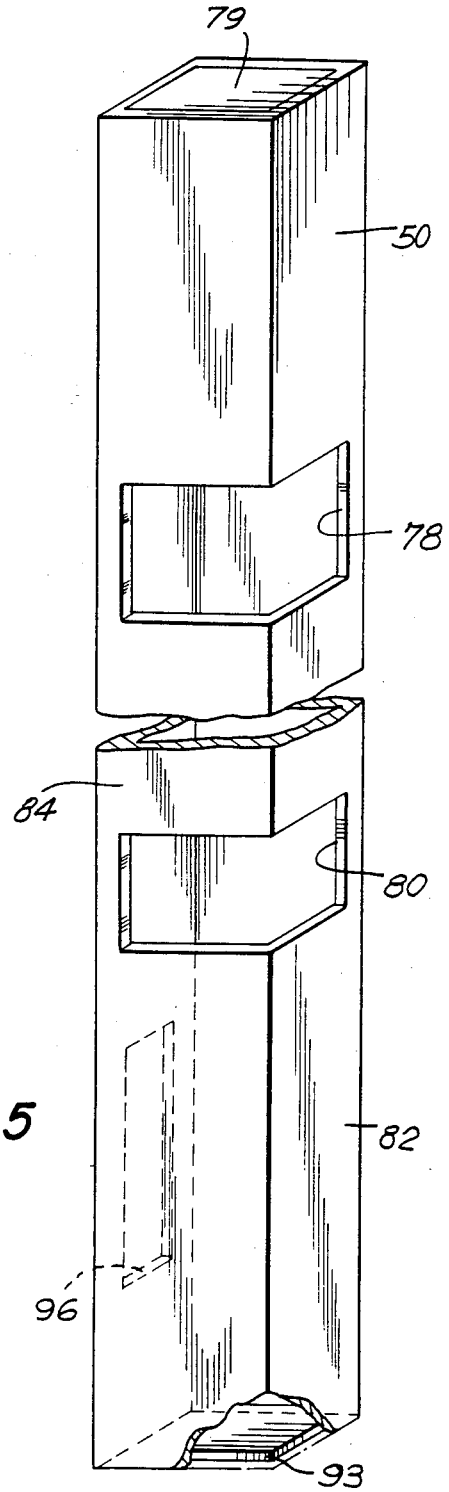
FIG. 5 is a perspective view of the tubular, lock housing member of the security gate apparatus of FIG. 1.

Security gate locking means to very securely lock the security gate 42 in the closed position thereof are indicated generally at 76 in FIGS. 1, 2, 3 and 4; and comprise vertically spaced slots 78 and 80 which are formed as best seen in FIG. 5 in the walls 82 and 84 of inner frame tubular member 50. Iron locking rods 86 and 88 extend inwardly from outer frame member 28 through slots 78 and 80 into tubular member 50 when the security gate 42 is in the closed position thereof in the manner best seen for locking rod 86 in FIG. 4. The locking rods preferably extend from bores provided therefor in the outer frame member 28 for maximum strength, and are strongly secured therein as by welding as indicated at 90 in FIG. 4 for locking rod 86. An iron locking bar is indicated at 92 in FIGS. 1, 2, 3 and 4; and is slidably disposed with substantial freedom of movement in tubular member 50 in the manner best seen in FIG. 2. FIG. 2 makes clear that locking bar 92 is not attached to anything within tubular member 50; but rather, lies freely therewithin with the lower edge of the locking bar resting by force of gravity on the bottom wall 93 of the tubular member. Tubular member 50 further includes a top wall 79 to prevent access to locking bar 92 from without the tubular member.

An iron locking bar operating lever is indicated at 94 in FIG. 2 and projects as shown inwardly from the lower end portion of the locking bar 92 to extend through a slot 96 provided therefor in tubular member 50 so as to be very readily accessible from the inside of window opening 12; with FIGS. 1 and 2 making particularly clear in this latter regard that the disposition as shown of the operating lever 94 just above the window sill 20 guarantees the ready and immediate accessibility of the same in terms of height above the relevant building floor level. The operating lever 94 is very strongly secured to the locking bar 92 as by welding as indicated at 98 in FIG. 2. The lower edge 100 of the operating lever 94 is bevelled as best seen in FIG. 2 to render effective grasping thereof from without the window opening 12, as by mechanical contrivance, extremely difficult.

Downwardly extending, generally L-shaped iron locking hooks are indicated at 102 and 104 in FIG. 2, and are very strongly secured as by welding as indicated at 105 and 107 to the locking bar 92 at the depicted, vertically spaced locations on the latter. The locking hooks 102 and 104 are configured, dimensioned, and disposed on locking bar 92 in such manner that with the locking bar in the lower or "locked" position thereof of FIG. 2, the locking hooks will overlie the locking rods 86 and 88 as shown to an extent which is more than sufficient to very securely lock the security gate 42 in the closed position thereof and absolutely prevent opening thereof from without the window opening 12 short, of course, of substantial destruction of the security gate apparatus 10; which would, in view of the particularly strong construction of that apparatus as depicted and described, be a most formidable task indeed, and one virtually certain to draw the attention of anyone within the building or even simply within the general area thereof.

Conversely, and with the locking bar 92 moved to the upper or "unlocked" position thereof as depicted in phantom in FIG. 2, as by the simple and very readily accomplished manual application of a sufficient upward force to operating lever 94, it will be clear that the respective lower edges 106 and 108 of the locking hooks 102 and 104 will be disposed above the locking rods 86 and 88 to thus enable the immediate pivotal movement of the security gate 42 to the open position thereof as depicted in phantom in FIG. 3. To this effect, an angle iron member 110 is strongly secured, as by welding as indicated at 112, to the tubular member 50 adjacent slot 96, and member 110 includes a portion which effectively functions as a very readily accessible and locatable handle, vis-a-vis operating lever 94, close by the latter for ready and convenient grasping to swing the security gate 42 open upon movement as described of the operating lever 94 upwardly to the "unlocked" position thereof. In fact, repeated and carefully monitored testing of the security gate 42 has established beyond question that the respective configurations as described of the handle portion 114 and operating lever 94, and the respective dispositions thereof in close proximity as depicted and described, enable virtually all persons to quickly open the security gate 42 through use of only one hand by, for example, using the relevant thumb to push upwardly on the operating lever 94 while concomitantly using the remaining fingers of the same hand to effectively grasp the handle portion 114 and pull on the same to swing the security gate 42 open.

In addition to effective function as described as a handle, it will be understood that member 110 as a whole most effectively functions to deny access to the operating lever 94 from without the window opening 12 by effectively shielding the lever from access by, for example, any mechanical contrivance as may be slipped between the security bars 62. This essential shielding of the operating lever 94 is further provided for by a flat iron plate 116 which is strongly secured, as by welding as indicated at 118, atop the angle iron member 110 to extend therefrom over the operating lever 94 as best seen in FIGS. 1 and 2; and by a relatively large, triangular flat iron plate 120 of FIG. 1 which is strongly secured, as by welding as indicated at 122, to the security bars 62, tubular member 50, and inner frame member 48, respectively. Handle portion 114 of member 110 additionally provides a surface for the ideal location of a simple label of operating instructions as indicated at 124 in FIG. 1. Due to the extreme simplicity of construction and operation of the security gate locking means 76 of our invention, it will be clear that this label need only bear a simple notation in the nature of "PUSH UP TO OPEN" with an arrow pointing to the operating lever 94. Of course, the visiblity of the operating lever may be effectively enhanced by painting the same in a particularly visible color, for example blaze flourescent orange, which will clearly contrast with the dark grey color of the surrounding iron members.

Further included in the security gate apparatus 10 of our invention, and particularly for use in those instances wherein the height of the window opening 12 significantly exceeds the height required for the openable security gate 42, is a fixed security gate assembly as generally indicated at 126 in FIG. 1. Assembly 126 comprises spaced, iron security bars 128, again of the depicted generally rectangular cross section, which extend generally horizontally as shown between the respective stationery outer frame members 28 and 30 to overlap each of the same at the inner side of the window opening 12. These security bars are very strongly secured to the inner frame members, as by welding as indicated at 129. Use of the assembly 126 as and where required enables optimal sizing of the openable security gate 42 while at the same time ensuring the security of the entire window opening 12 with minimal additional restriction on the light-admitting and ventilating characteristics of that opening. In addition, the provision for assembly 126 significantly increases the versatility of application of the security gate apparatus 10 of our invention with regard to the height range of building openings which can be effectively secured by those apparatus: it being clear to those skilled in this art that for use with openings of significantly lesser height than that depicted in FIG. 1, only one security bar 128 or none at all might be required (in this latter instance inner frame member 46 of security gate 42 would be disposed close to or perhaps even overlap outer frame member 24 when the security gate 42 were in the closed position thereof); while for use with building openings of significantly greater height than that depicted in FIG. 1, fixed security gate assembly 126 might comprise three or more spaced security bars 128.

Referring again to security gate locking means 76, which as disclosed do in fact require only a single moving part, it is believed made clear that those locking means are, in fact, virtually fail-safe. This is to say that since it is impossible to move security gate 42 to its fully closed position without putting upward pressure on operating lever 94 sufficient to move operating bar 92 upwardly to the extent required for the lower edges 106 and 108 of the locking hooks 102 and 104 to clear the locking rods 86 and 88, and since once security gate 42 is fully closed locking bar 92 will automatically fall within tubular member 50 under the influence of gravity to its "locked" position upon the release of the upward pressure on operating lever 94, there is virtually no way that the locking means can fail to lock upon closure of the security gate short, of course, of parts breakage which, in view of the particularly sturdy construction as disclosed, is clearly most unlikely. Of course, security gate 42 could be arranged, as through appropriate shimming of the hinges 68 and 70 or the like, to swing outwardly to the fully or partially opened position thereof whenever the same is not "locked" to thus call attention to that fact and dictate the prompt locking of the gate upon notice of that condition.

Figure 6:
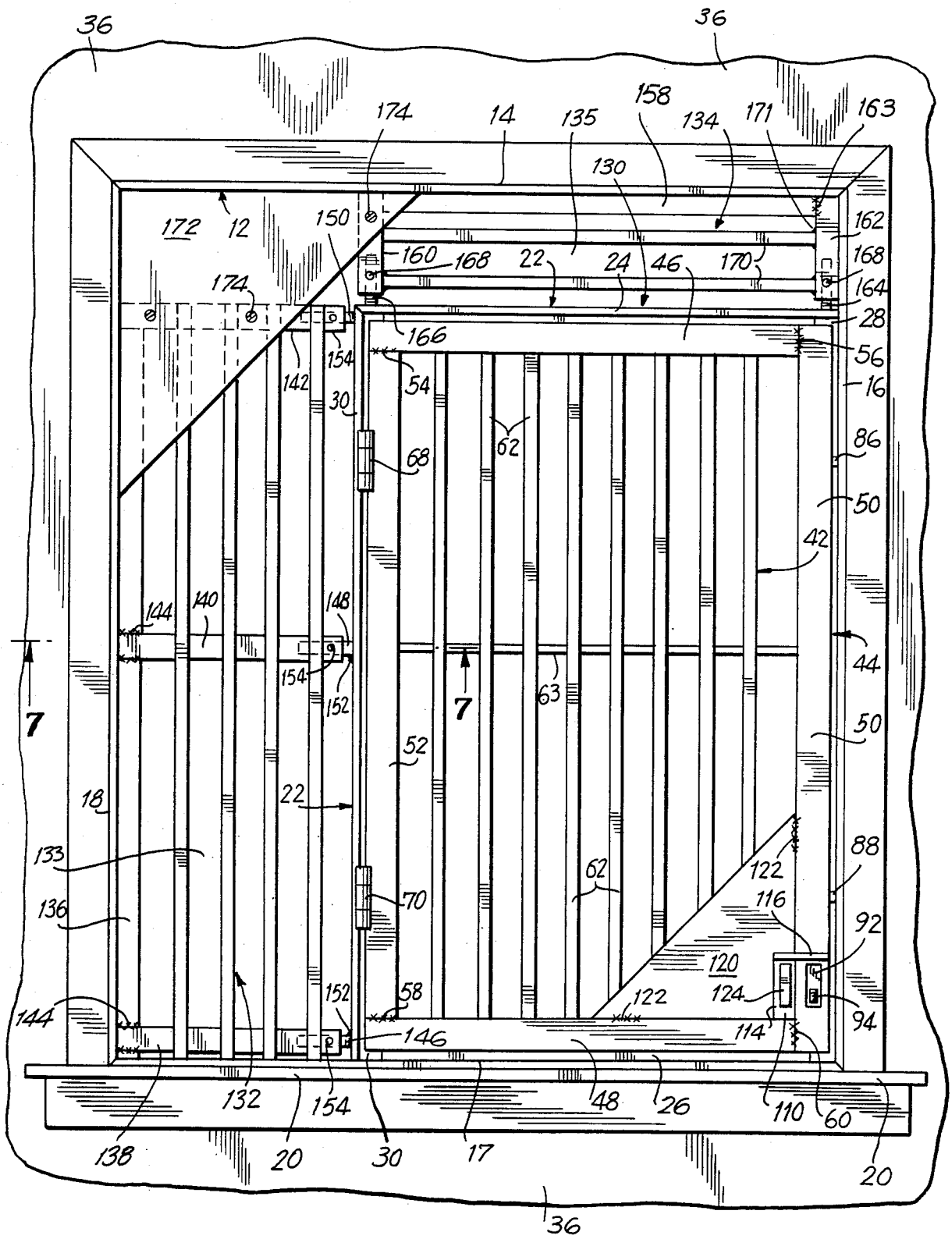
FIG. 6 is a front elevational view of a second embodiment of new and improved security gate apparatus constructed and operative in accordance with the teachings of our invention, again as operatively disposed in a window opening and seen from the inside of the latter.

A second embodiment of security gate apparatus constructed and operative in accordance with the teachings of our invention is indicated generally at 130 in FIG. 6; and is notable for the even greater degree of versatility of application provided thereby with regard to the size of the building openings which may be readily and strongly secured thereby. The security gate apparatus 130 of FIG. 6 are very similar in basic configuration to the security gate apparatus 10 of FIGS. 1 through 5; and like apparatus components will thus be seen to bear like identifying numerals in both embodiments. Thus, the security gate apparatus 130 will be seen to again comprise a stationary outer frame 22, and the lockable security gate 42 supported therefrom by hinges 68 and 70. In the security gate apparatus 130 of FIG. 6, however, it will readily be seen that the stationary outer frame 22 is configured and dimensioned to be coextensive in both width and height with the security gate 42—as opposed to the security gate apparatus 10 of FIGS. 1 through 5 wherein the stationary outer frame 22 is coextensive with the security gate 42 in width, only, and is more extensive than the same in height—and that the extent of the window opening 12 exceeds in both width and height the extent of the stationary outer frame 22. Accordingly, fixed security gate assemblies as respectively generally indicated at 132 and 134, each of which is of readily and conveniently adjustable extent as described in detail hereinbelow, are provided as shown in FIG. 6 to very strongly secure the space 133 between generally vertically extending angle iron member 30 of stationary outer frame 22 and window frame member 18 which results from the difference in width between window opening 12 and the stationary outer frame 22, and to very strongly secure the space 135 between generally horizontally extending angle iron member 24 of stationary outer frame 22 and window frame member 14 which results from the difference in height between window opening 12 and stationary outer frame 22.

More specifically, fixed security gate assembly 132 may readily be seen to comprise a generally vertically extending angle iron member 136 which is strongly secured as by spaced screws, not shown, through window frame member 18 into the building wall 36. Spaced, open ended tubular members 138, 140 and 142, taking for example the general form of iron tubular member 50 of FIG. 5, are very strongly secured as by welding as indicated at 144 in FIGS. 6 and 7, to angle iron member 136 to extend generally horizontally therefrom toward the security gate 42 as shown. Complementally shaped solid iron members 146, 148 and 150, which are respectively readily telescopable into tubular members 138, 140 and 142, are very strongly secured to stationary outer frame angle iron member 30 as by welding as indicated at 152 to extend generally horizontally therefrom into tubular members 138, 140 and 142 as best seen for solid member 148 in FIG. 7. Bolts or pins 154 extend through aligned bores provided therefor in members 138 and 146, 140 and 148, and 142 and 150, respectively, to very strongly secure the same together as best seen for members 140 and 148 in FIG. 7.

Figure 7:
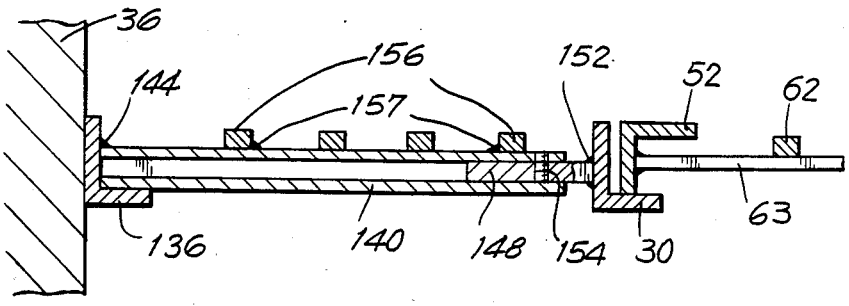
FIG. 7 is a cross sectional view taken generally along line 7—7 in FIG. 6.

Spaced, generally vertically extending iron bars 156 are very strongly secured, as by welding as indicated at 157 in FIG. 7, to tubular members 138, 140 and 142 to complete the fixed security assembly 132.

In like manner, fixed security gate assembly 134 comprises generally horizontally extending angle iron member 158 secured as described by spaced screws, not shown, in window opening 12; spaced, generally vertically extending tubular members 160 and 162 strongly secured to angle iron member 158 as by welding as indicated at 163 and extending downwardly therefrom; spaced, generally vertically extending solid members 164 and 166 strongly secured as by welding, not shown, to stationary outer frame member 24 and extending upwardly therefrom to respectively telescope as shown into tubular members 162 and 160; bolts or pins 168 which extend as described through aligned bores in tubular members 160 and 162 and solid members 164 and 166 to strongly secure the same together; and spaced, generally horizontally extending security bars 170 extending between and strongly secured to tubular members 160 and 162 by welding as indicated at 171.

A triangular iron plate 172 is very strongly secured from within the building opening 12 as by metal screws as indicated at 174 to angle iron members 136 and 158, and tubular members 142 and 160 to close off and secure the space between tubular members 142 and 160 and complete the fixed security assemblies 132 and 134.

With this construction as described of security gate apparatus 130, it will be clear to those skilled in this art that standard sized, lockable security gate 42 and stationary outer frames 22 may, in essence, be mass-produced at a central fabricating location to very significant economic advantage, and readily and conveniently adapted in situ to effective installation in window openings 12 of a very wide range of larger sizes. More specifically, since the respective fixed security assemblies 132 and 134 can be readily fabricated in situ to the desired sizes thereof through the simple expedients of cutting and welding, and since the respective solid members 146, 148, 150, 164 and 166 telescope into the respective tubular members 138, 140, 142, 162 and 160 to thus in any event provide for some measure of adjustability with regard to the final effective sizes of the fixed security assemblies 132 and 134; it will be clear that standard sized stationary outer frames 22 and lockable security gates 42 can be effectively used, in conjunction with fixed security assemblies 132 and 134 as fabricated and/or adjusted to the required sizes in situ, to secure window openings 12 of a very wide variety of sizes larger than that of the same.

The security gate apparatus 10 and 130 of our invention are perfectly adapted for use in the securing of virtually any kind of opening of virtually any reasonable size in virtually any kind of building which must be secured against unauthorized entry from without the building; but which must at the same time, and clearly even more importantly, provide for virtually immediate and unimpeded exit of the building occupants in case of any and all emergencies. These openings would include, but not be limited to, window and door openings and the like; and these buildings would include but not be limited to, private homes, apartments, office buildings, hospitals, schools, hotels, restaurants, theaters, sports stadia, and retail stores and the like. Of course, the extreme simplicity as described of the operation of locking means 76, and the disposition of locking means operating lever 94 at the lower edge of the relevant building opening, render the same ideal for virtually immediate operation, particularly by transients who have had no previous exposure thereto, and by those who are normally short of stature such as children. Too, this disposition of the operating lever 94 at the lower building opening edge renders the raising thereof to unlock the security gate 42 substantially easier than would a "higher" operating lever disposition, since the former requires movement from below rather than above the shoulder; and this could be of particular importance with regard to those of limited physical capacity such as children, the elderly, and/or the infirm.

With further regard to security, it will be clear that the inclusion as described of two spaced locking hook and locking rod combinations, namely 102 and 86, and 104 and 88, respectively, in essence double the strength of the locking means 76 and render the destruction thereof to force open the security gate 42 virtually impossible in the absence of particularly radical methods and/or equipment which are, in any event, certain to draw attention. Too, in addition to providing for very substantial resistance to deformation, it will be clear that the use of the angle iron configuration for the respective outer frame members 24, 26, 28 and 30, and the respective inner frame members 46, 48, 50 and 52, provides the significant additional advantage of shielding, at least in part, the hinges 68 and 70, and the attachment screws 38 and 40, from removal or destruction by prying or other techniques from outside of the building opening 12. This is made particularly clear by FIG. 3 for attachment screws 38 and 40 and hinge 70.

Although disclosed as comprising primarily iron components which are attached togetner by welding, it is clear that the security gate apparatus 10 and 130 are not limited to fabrication from that material or by that attachment technique.

Various changes may, of course, be made in the herein-disclosed preferred embodiments of our invention without departing from the spirit and scope of that invention as defined by the appended claims.

What is claimed is:

1. In security gate apparatus for securing an opening in a building and including fixed support means operatively associated with said building opening, security gate means supported from said support means and moveable relative thereto between a closed security gate means position wherein the same are operable to prevent entry to the building through the building opening, and an open security gate means position wherein the same are not so operable, and locking means operatively associated with said support means and said security gate means and operable to lock said security gate means in the closed position thereof, the improvements comprising, said locking means comprising a locking member which is generally vertically moveable between a first locking member position wherein the locking member is operable to lock said security gate means in the closed position thereof, and a second locking member position wherein the same is not so operable, locking member mounting means surrounding said locking member at least in part to deny access thereto, and locking member operating means operatively associated with said locking member and said locking member mounting means and operable to enable movement of said locking member from said first position thereof to said second position thereof, said locking member being operable when in the first position thereof to prevent movement of said security gate means into the closed position thereof, said locking member being operable to automatically move from said second position thereof to said first position thereof and remain therein to lock said security gate means upon movement of the latter into said closed position thereof.

2. In security gate apparatus as in claim 1 wherein, said locking member is generally elongate and is generally vertically disposed in said locking member mounting means, and said first locking member position is below said second locking member position.

3. In security gate apparatus as in claim 1 wherein, said locking member operating means are disposed at the lower part of said building opening.

4. In security gate apparatus as in claim 1 wherein, said locking member is freely disposed in said locking member mounting means, and is freely moveable therewithin under the influence of the force of gravity from said second locking member position to said first locking member position.

5. In security gate apparatus as in claim 1 wherein, said locking member mounting means and said locking member are carried by said security gate means, and said locking member operating means are disposed at the lower part of said security gate means.

6. In security gate apparatus as in claim 1 wherein, said security gate means comprise a frame defining the same, and wherein said locking member mounting means form part of said frame.

7. In security gate apparatus as in claim 1 wherein, said locking member mounting means comprise a generally vertically oriented, generally tubular member, and wherein said locking member is generally vertically disposed therewithin.

8. In security gate apparatus as in claim 1 wherein, said security gate means are of lesser extent than said building opening, and wherein said security gate apparatus further comprise fixed security means operatively associated with said support means and said security gate means and operable to prevent entry into the building through that portion of the buliding opening which is not closed by said security gate means when the latter are in the closed position thereof.

9. In security gate apparatus as in claim 1 wherein, said locking member comprises spaced locking elements which are independently operable to lock said security gate means in the closed position thereof at spaced locations on the security gate means.

10. In security gate apparatus as in claim 8 wherein, said fixed security means are of readily adjustable extent to adapt the security gate apparatus for use in the securing of building openings of varying extents.

11. In security gate apparatus as in claim 1 wherein said building opening comprises closure means independent of said security gate apparatus for closing said building opening, and wherein the improvements further comprise, means for pivotally supporting said security gate means from said support means to the inside of said closure means, said security gate means being pivotally moveable thereon from said closed security means position to said open security gate means position to the inside of said building opening.

12. In security gate apparatus as in claim 9 wherein, said locking member is a unitary member.

13. In security gate apparatus for securing an opening in a building and including fixed support means operatively associated with said building opening, security gate means supported from said support means and moveable relative thereto between a closed security gate means position wherein the same are operable to prevent entry to the building through the building opening, and an open security gate means position wherein the same are not so operable, and locking means operatively associated with said support means and said security gate means and operable to lock said security gate means in the closed position thereof, the improvements comprising, said locking means comprising a locking member which is moveable between a first position thereof wherein the locking member is operable to lock said security gate means in the closed position thereof, and a second locking member position wherein the same is not so operable, locking member mounting means surrounding said locking member at least in part to prevent access thereto, and locking member operating means operatively associated with said locking member and said locking member mounting means and operable to enable movement of said locking member from said first position thereof to said second position thereof, said security gate means comprising a frame defining the same, said locking member mounting means comprising a generally tubular member forming part of said frame, said locking member being disposed within said tubular member, said tubular member being generally vertically oriented, said locking member being generally elongate and generally vertically oriented within said tubular member, said locking member being freely disposed in said tubular member, and being freely moveable therewithin under the influence of the force of gravity from said second locking member position to said first locking member position.

14. In security gate apparatus as in claim 13 wherein, said tubular member comprises a slot formed therein, said fixed support means comprise a locking element operable to extend into said slot when said security gate means are in the closed position thereof, and said locking member comprises a locking element operable to cooperate with said support means locking element within said tubluar element to lock said security gate means in the closed position thereof.

15. In security gate apparatus as in claim 14 wherein, said tubular member comprises at least two of said slots formed therein at vertically spaced locations thereon, said fixed support means comprise at least two of said locking elements which are respectively operable to extend into said slots when said security gate means are in the closed position thereof, and said locking member comprises at least two locking elements formed at vertically spaced locations thereon and respectively operable to cooperate with said support means elements within said tubular element to lock said security gate means in the closed position thereof at spaced locations on the same.

16. In security gate apparatus as in claim 14 wherein, said locking member is generally vertically moveable between said first position thereof wherein said locking member and fixed support means locking means cooperate to lock said security gate means in the closed position thereof, and said second position thereof wherein said locking member and fixed support means locking elements do not so cooperate.

17. In security gate apparatus as in claim 14 wherein, said support means locking element and said locking member locking element are operable to prevent movement of said security gate means into said closed position thereof with said locking member in said first position thereof.

18. In security gate apparatus as in claim 14 wherein, said security gate means are of lesser extent than said building opening, and wherein said security gate apparatus further comprise fixed security means operatively associated with said support means and said security gate means and operable to prevent entry into the building through that portion of the building opening which is not closed by said security gate means when the latter are in the closed position thereof.

19. In security gate apparatus as in claim 14 wherein, said locking member is generally vertically moveable between said first and second positions thereof, and said said second locking member position is above said first locking member position.

20. In security gate apparatus as in claim 18 wherein, said fixed security means are of readily adjustable extent to adapt the security gate apparatus for use in the securing of building openings of varying extents.

* * * * *